United States Patent [19]

Knapp

[11] 4,448,106

[45] May 15, 1984

[54] METHOD OF IDENTIFYING HARD TARGETS

[75] Inventor: Richard D. Knapp, Santa Ana

[73] Assignee: McDonnell Douglas Corporation, Long Beach, Calif.

[21] Appl. No.: 258,630

[22] Filed: Apr. 29, 1981

Related U.S. Application Data

[63] Continuation of Ser. No. 921,962, Jul. 5, 1978, abandoned.

[51] Int. Cl.[3] ..... F41F 5/00; F42B 13/34

[52] U.S. Cl. ..... 89/1 A; 102/501; 102/513; 343/18 B

[58] Field of Search ..... 102/513, 334, 364, 365, 102/366, 367, 501, 489; 89/1 A; 343/18 B, 911 L; 244/3.13, 3.16, 3.19; 367/1, 87, 99

[56] References Cited

U.S. PATENT DOCUMENTS

| | | | |
|---|---|---|---|
| 397,031 | 1/1889 | Silas | 102/1 A |
| 2,353,386 | 7/1944 | Bourcier | 256/1 |
| 2,397,088 | 3/1946 | Clay | 250/2 |
| 2,422,920 | 6/1947 | Nichols | 102/2 |
| 2,466,707 | 4/1949 | Janney | 102/8 |
| 2,805,065 | 9/1957 | Cotton | 273/105.3 |
| 3,037,454 | 6/1962 | Young | 102/38 |
| 3,358,602 | 12/1967 | Chope | 102/36 |
| 3,374,313 | 3/1968 | Mathes et al. | 178/7.83 |
| 3,429,263 | 2/1969 | Snyder et al. | 102/92.7 |
| 3,483,837 | 3/1970 | Peterson | 102/60 |
| 3,526,198 | 9/1970 | Mathes | 114/20 |
| 3,712,228 | 1/1973 | Handler et al. | 102/60 |
| 3,712,229 | 1/1973 | Schock | 102/489 |
| 3,757,632 | 8/1973 | Bellinger | 102/1 A |
| 3,780,615 | 12/1973 | Peyton et al. | 89/1 A |
| 3,811,381 | 5/1974 | Fichter, Jr. et al. | 102/513 |
| 3,914,769 | 10/1975 | Andrews | 343/911 L |
| 3,935,817 | 2/1976 | Riparbelli | 102/52 |
| 3,948,184 | 4/1976 | Pierre et al. | 102/93 |
| 3,954,060 | 5/1976 | Haag et al. | 102/69 |
| 3,956,990 | 5/1976 | Rowe | 89/2 A |
| 3,973,466 | 8/1976 | Marcus et al. | 89/1 A |
| 4,055,104 | 10/1977 | Osofsky et al. | 89/1 A |
| 4,065,753 | 12/1977 | Paul, Jr. | 340/152 T |

*Primary Examiner*—Harold J. Tudor

*Attorney, Agent, or Firm*—Henry M. Bissell; George W. Finch; Donald L. Royer

[57] ABSTRACT

A system for identifying a hard target from a distance. A delivery vehicle, such as a missile or bomb, is adapted to be dropped from the air. The delivery vehicle contains a plurality of hard target identifier or kinetic penetrator elements. Each of the elements has a nose portion of aerodynamic shape and a plurality of fins connected thereto. When ejected from the delivery vehicle, the elements will reach a substantial velocity, and hence, kinetic energy to penetrate partially into a hard target. A soft surrounding area, such as earth or water will absorb the elements. The elements may be passive for reflecting waves, such as acoustic waves or electromagnetic energy. Alternatively, they may be active elements capable of ejecting a dye, such as a fluorescent dye, or for transmitting acoustical or electromagnetic energy upon being activated.

14 Claims, 18 Drawing Figures

METHOD OF IDENTIFYING HARD TARGETS

This is a continuation, of application Ser. No. 921,962, filed July 5, 1978, now abandoned.

BACKGROUND OF THE INVENTION

1. Field of the Invention

This invention relates generally to a system for identifying a hard target from a distance, and particularly relates to small elements deliverable from an airborne vehicle and capable of acquiring a large kinetic energy.

2. Description of the Prior Art

In the past it has been attempted to destroy hard targets from a distance by conventional warheads. Such hard targets may, for example, consist of a concrete road, a metal bridge, or moving vehicles, such as tanks and armored cars. Because of the errors associated with the location of the target and the warhead delivery system, many warheads must be delivered to produce a single direct hit on such a hard target. Additionally, many direct hits are required to destroy a hard target because of its strong construction.

In order to reduce the number of warheads required to destroy a target, modern weapons utilize expensive seekers and guidance system. Such system must distinguish the target from its background and maintain lock-on until the warhead detonates.

It has also been proposed to designate from a distance the target, for example, by means of a laser beam. Nevertheless, the designation system must be disposed relatively close to the target to provide satisfactory illumination of the seeker of the homing vehicle for its proper operation. Hence, the personnel operating the laser become rather vulnerable.

Many systems have been evolved in the past to designate hard targets. Among these is patent 3,358,602 which issued to Chope. The patent discloses a nuclear radiation generating system to reveal the location of enemy troops or equipment. To this end, beta-emitting particles are mixed with the gunpowder to be used for ammunition which somehow falls into the hands of the enemy. When the ammunition is fired, the gun barrel becomes an emitter of X-rays which can now be detected by airborne sensors.

The patent to Mathes et al., No. 3,526,198 is directed to an anti-submarine attack method. Sonar is utilized at long ranges to locate submerged submarines. A high-speed and a low-speed vehicle are utilized as well as standard sonar techniques. The sonar signal is generated from the friendly vehicle and the system depends on an echo from the submarine hull for location of the submarine.

The U.S. patent to Handler et al., No. 3,712,228, discloses a target marker warhead. The conventional warhead on a guided missile is replaced by a large spotting charge. The spotting charge detonates by means of a standard fuse which provides an aim point for subsequent missiles. Hence, the problem still remains that the target must first be detected and discriminated by some other means.

Various armor piercing bombs and similar devices have been devised in the past. Among these is the U.S. patent to Nichols, No. 2,422,920 which discloses an armor piercing drop bomb. Reaction forces are utilized to accelerate the armor piercing bomb to velocities sufficient to penetrate armor. The U.S. patent to Riparbelli, No. 3,935,817 discloses a penetrating spear. Here rocket propulsion is combined with the kinetic energy penetrator to destroy armor targets. In this case, a rocket motor is used to provide the spear with sufficient kinetic energy.

The U.S. patent to Peterson, No. 3,483,837, discloses a streamlined missile for the location of submarines which is launched from a ship into the water. The missile is provided with a magnet to attach itself to the submarine. The missile further contains a normally inactive pressure-responsive acoustic source activated by the water pressure when the missile adheres to the submarine. The acoustic source then signals the presence of the submarine.

SUMMARY OF THE INVENTION

In accordance with the present invention, there is provided a system for identifying a hard target from a distance. The system comprises a delivery vehicle, such as a missile, a bomb, or the like, adapted to be dropped from the air. The delivery vehicle contains a plurality of hard target identifier kinetic penetrator elements. Each of the elements has a nose portion of aerodynamic shape and a plurality of fins connected thereto. When these elements are ejected from the delivery vehicle, they will reach a substantial velocity, and hence, kinetic energy. This enables them to penetrate partially into a hard target. Such a hard target may, for example, consist of moving targets, such as tanks, submarines, armed vehicles, and the like. On the other hand, they can be used against stationary targets, such as bridges, dams, boatways, bunkers, and the like. Such hard targets are identified because the penetrator elements are absorbed or buried by the soft area surrounding a hard target, such as ordinary earth, water, and the like.

The elements may be of the passive type and adapted to reflect a wave, such as an acoustic wave. On the other hand, they may be arranged to reflect electromagnetic energy, such as light, infrared radiation, or radio frequency energy. Still further, the elements may be of the active type and may be designed to radiate energy upon impact. They may be designed to generate acoustic energy or, alternatively, they may contain a radio-frequency generator for radiating the energy.

Finally, the elements may be utilized to identify submarines under the water. Here each element may contain a magnet to attach itself to the submarine. The motion of the submarine may activate a suitable mechanism to drive an acoustic signal generating wheel or to energize a suitable electric oscillator. Finally, the elements may be provided on their outer surface with a reflector of light, such as blue-green laser light.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENTS

Figure 1:
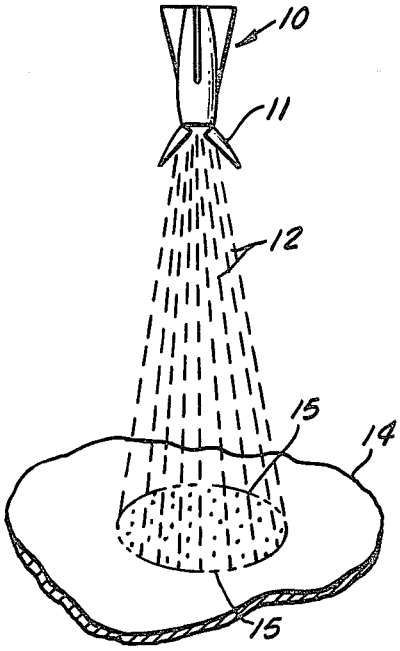
FIG. 1 is a view in perspective illustrating a delivery system, such as a bomb for ejecting a plurality of kinetic penetrator elements, and showing the ground with an impact pattern.

Referring now to the drawings and particularly to FIG. 1, there is illustrated schematically a system for identifying a hard target from a distance. The system includes a delivery vehicle 10. Such a delivery vehicle may, for example, be a bomb, a surface-to-surface, or air-to-surface rocket, a cruise missile, artillery or mortar projectile, or an aircraft stand-off missile. Such a stand-off missile is a guided missile launched from a substantial distance, such as 100 miles or more.

The delivery vehicle 10 is adapted to be dropped from the air and includes a suitable, conventional ejection system 11 for ejecting the hard target identifiers 12. The hard target identifier elements 12 may, for example, be kinetic penetrator elements, as will be more fully described hereinafter.

As will be seen in FIG. 1, the elements 12 will hit a hard surface 14 in a substantially circular impact pattern 15. Since the identifier elements may be kinetic penetrators, they will penetrate at least partially a hard target. Such hard targets may include stationary targets, such as bridges, dams, bunkers, roadways, and the like. Alternatively, they can also be used for identifying moving targets, such as tanks, submarines, armed vehicles, and the like.

It will be realized that since the hard target identifier elements 12 acquire a considerable velocity and, hence, kinetic energy when dropped from the air, they will readily pass through a soft area surrounding a hard target, such as earth, water, and the like.

Figure 2:
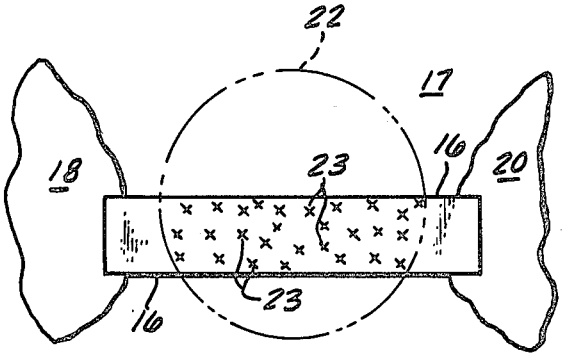
FIG. 2 is a plan view of a bridge with surrounding territory, and illustrating the hard target identifying elements deposited on the bridge.

By way of example, FIG. 2 illustrates a bridge 16 which may, for example, be crossing water or crossing over low-lying ground, indicated at 17. The bridge interconnects two areas, 18 and 20. The impact area of the elements 12 is shown by the circle 22. The crosses 23 identify the kinetic penetrator elements, such as 12, which penetrate the bridge and are embedded therein. On the other hand, other elements are completely absorbed by the area surrounding the bridge.

Figure 3:
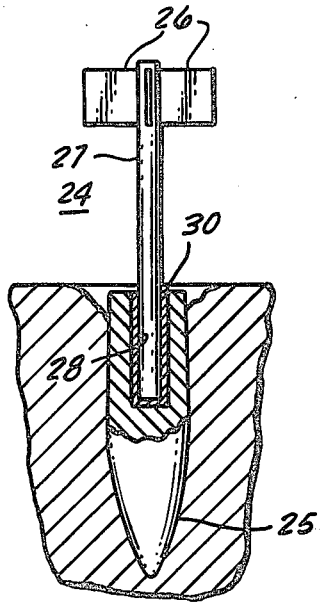
FIG. 3 is an elevational view of a kinetic penetrator element in accordance with the invention and including a dipole antenna for returning electromagnetic radiation.
Figure 5:
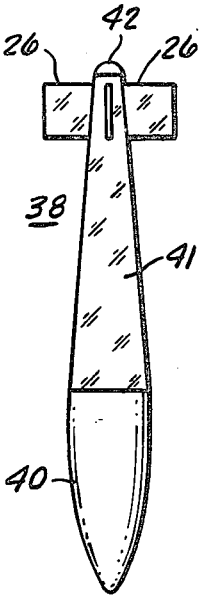
FIG. 5 is an elevational view of an element in accordance with the present invention having a surface for reflecting, for example, light emitted by a laser.
Figure 4:
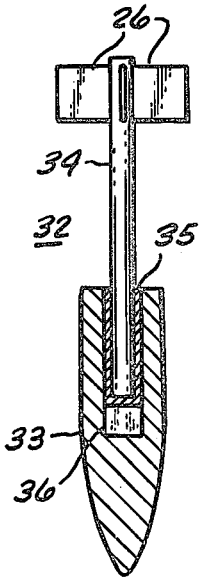
FIG. 4 is an elevational view of a penetrator element including a diode and a monopole antenna for returning a multiple of the frequency of the transmitted electromagnetic energy.
Figure 6:
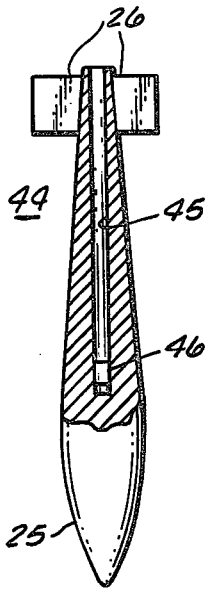
FIG. 6 is an elevational view of an element designed to operate as an optical flare upon impact and containing a flare or thermal battery.

A number of passive elements are illustrated in FIGS. 3–5 to which reference is now made. Thus, the element 24 of FIG. 3 is provided with a hardened steel nose 25 to enable the element to penetrate at least partially into a hard target and to be embedded therein. The element 24 is also provided with a plurality of reflectors which may be stabilizing fins 26. The fins 26 are connected to the nose portion 25 by a monopole antenna 27 which is disposed in the nose portion 25 in an opening 28 therein. An insulating material 30 insulates the monopole antenna 27 from the steel nose 25.

Thus, the kinetic penetrator element 24 of FIG. 3 is adapted to reflect electromagnetic energy, such as radio frequency energy. In this manner, the target may be readily found by retransmitting the energy to which the monopole antenna 27 or the reflectors 26 are tuned.

The kinetic penetrator element 32 of FIG. 4 again has a hardened steel nose 33 into which is inserted a monopole antenna 34, insulated from the nose 33 by insulating materials 35. The element 32 may again be provided with reflector fins 26. In this case, however, a diode 36 is electrically connected to the monopole antenna 34. Since the diode 36 has a non-linear characteristic, it may be used to double or triple a transmitted radio frequency and retransmit the harmonic frequency. This will make it even easier to locate such an element embedded on a hard target.

FIG. 5 illustrates another element 38 which may also be provided with stabilizing fins 26 connected to a body 40 having a hardened metal nose. As shown at 41, the rear part of the body of the element 38 is coated with a light reflective material while a retroreflector 42 may form its rear portion. The reflective material 41 and the retroreflector 42 may be designed to reflect laser radiation in a predetermined frequency range.

The reflector portion 42 may consist of a Luneberg lens which is made up of small spheres or a corner cube prism to provide a reflector of electromagnetic energy.

As indicated before, the fins 26 besides providing aerodynamic stability, may also act as corner reflectors for either radio frequency energy or for light energy. This will be evident because the fins 26 are arranged in the form of a cross.

The elements, such as 24 of FIG. 3 and those to be described hereinafter, may obtain a velocity on the order of 2,000 feet per second. This in turn will impart a substantial kinetic energy to the elements. Assuming, for example, a delivery vehicle having a payload of 1,000 pounds, it may contain small elements on the order of 4,000 to 70,000 in number. Thus, each element may have a weight on the order of 6 grams up to about one-quarter pound.

Due to the kinetic energy of the kinetic penetrator elements, they are capable of embedding themselves in about two inches of concrete or they may embed themselves to a depth of one inch in steel plate. The nose portion of the elements has a tendency to curve upon impact. This makes removal extremely difficult and requires a force of several thousand pounds for removal or extraction. In addition, it is feasible to select suitable metals so that the element welds itself, due to the heat of impact, to a metallic, hard target which further discourages removal of the elements.

The elements illustrated in FIGS. 6–10 are all active elements. In other words, they are capable of radiating electromagnetic energy, such as light, infrared, or radio frequency energy. Thus, referring to FIG. 6, there is shown an element 44 which will issue a light beacon. The element again is provided with a hardened steel nose 25 and fins 26. A hollow portion 45 of the body of the element is adapted to house a material which will burn as a flare. It also contains a percussion igniter 46, which will ignite the flare upon impact to provide a hot flare or smoke identifier. It will be evident that the flare may either issue light in the visible spectral region or infrared light.

Figure 7:
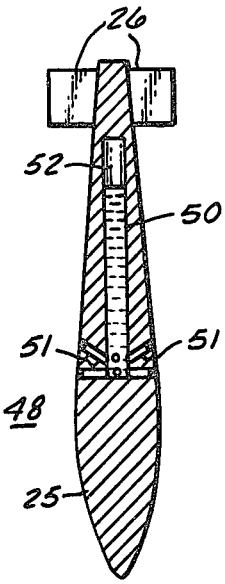
FIG. 7 is an elevational view of an identifier element containing a dye or the like and impact actuated means, such as a mass plunger for ejecting the dye upon impact.

The embodiment of the element of FIG. 7 has the purpose to eject luminous dye due to the impact of the element. Thus, the element 48 again has a hardened nose portion 25 and tail fins 26. An internal aperture 50 extending through at least a portion of the body contains the desired dye or paint which may be ejected through openings 51. The housing also contains a mass 52 in contact with the dye in the opening 50. It is activated by inertia upon impact of the element on a hard surface and will physically push the dye out through the ejection ports 51. The ejected luminous dye will identify the target for an optical or infrared seeker that contains a suitable sensor for the particular wave-length of the light.

Figure 8:
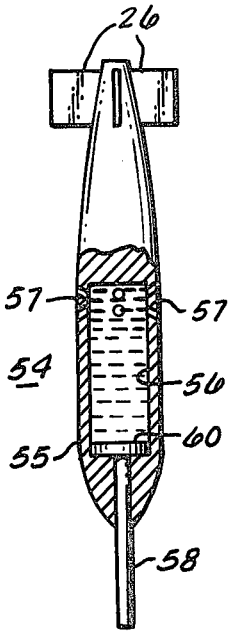
FIG. 8 is an elevational view of a similar element containing a dye or the like and arranged to eject the dye by means of a push-rod upon impact.

FIG. 8 illustrates a modification of the active element of FIG. 7. The element 54 may again have a hardened steel housing 55 and tail fins 26. It has an internal opening 56 to house a phosphorescent dye or paint which may be ejected through the ejection ports 57. The element is activated when a push rod 58 makes contact with a hard surface to force its piston 60 upwardly into the housing 56, thereby to eject the dye contained therein through the ejection ports 57.

It will, of course, be understood that for either the embodiment of FIG. 7 or FIG. 8, a luminous dye, a phosphorescent dye, or some other suitable paint may be used.

Figure 9:
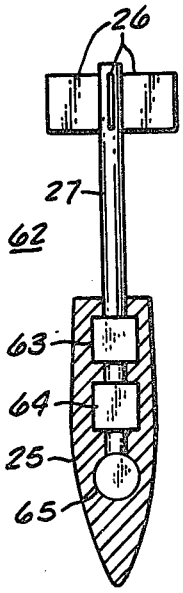
FIG. 9 is an elevational view of a penetrator element including a transmitter and antenna to generate and radiate electromagnetic energy upon the receipt of an acoustical signal.

The element 62 of FIG. 9 is a transducer arranged to respond to acoustical energy. The element 62 may again be provided with a hardened steel nose 25, a monopole antenna 27, and tail fins 26. Within the body 25, there is provided a transmitter 63 connected to a power supply 64 and an acoustical pick-up 65.

The acoustical pick-up 65 may detect the approach of a vehicle or other heavy equipment on a road or the like on which the elements 62 are embedded. When the acoustic signal exceeds a certain level, the pick-up 65 will energize the power supply 64 so that the transmitter 63 will generate while the monopole antenna 27 radiates a suitable electromagnetic signal.

Figure 10:
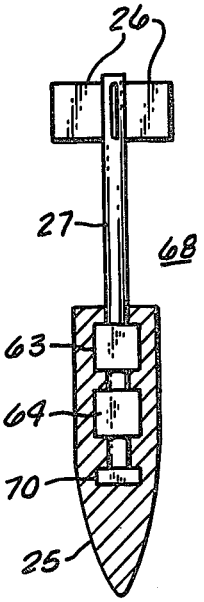
FIG. 10 is an elevational view of a similar element for transmitting electromagnetic energy and capable of being activated upon impact by a G-switch.

FIG. 10 illustrates a transmitter element 68. The element 68 is again provided with a hardened steel nose 25, a plurality of tail fins 26 which may be used as stabilizing fins, and connected by a monopole antenna 27 to the nose portion 25. The nose portion 25 again contains a transmitter 63 and a power supply 64 connected together and activated by a so-called G-switch activator 70. This is simply a switch activated by its inertia upon impact of the element.

It is feasible, for example, to drop in one payload elements 62 and 68 mixed with each other on a road. The signal emitted by the element 62 of FIG. 9 may then be retransmitted by the transmitter 68 of FIG. 10.

It is also possible to eject from a delivery vehicle, in addition, tire penetrating elements which would interdict the movement of vehicles so that their presence can then be detected by the element 62 of FIG. 9 and reported.

The elements illustrated in FIGS. 11–18 are all designed to be used for identifying hard targets underwater, such as submarines.

Figure 11:
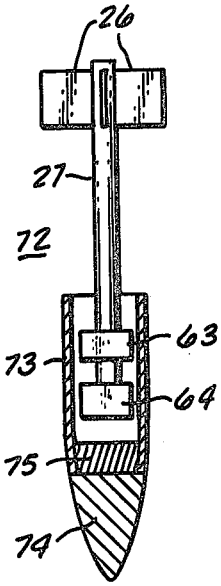
FIG. 11 is an elevational view of another element designed to identify a hard target underwater and including a magnetic hull portion and an oscillator for generating and radiating electrical energy.

Thus, FIG. 11 illustrates an element 72 which is an active element. It is activated upon attachment to a submarine. It has a housing 73 of aerodynamic shape having a nose portion 74 which consists of an insulator, soluble in water. The insulator 74 may, for example, consist of a polyvinyl alcohol plastic or suitable metallic salts, or the like. This is followed by a magnetic portion 75 for attaching the element after the nose tip 74 has been dissolved to a metallic mass, such as a submarine. It is provided again with a power supply 64 and an oscillator 63 operating as a transmitter and coupled to the antenna 27 which bears the stabilizing or tail fins 26.

The oscillator 63 may also generate a signal suitable to launch an acoustic wave by the antenna 27 to provide a sonar emitter. This in turn can be used for attracting homing torpedoes and the like.

Figure 12:
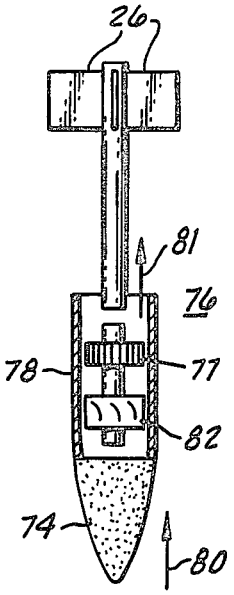
FIG. 12 is an elevational view, parts being broken away, and including an acoustic signal generating wheel driven by a water turbine wheel and adapted to be operated when the element attaches itself to a moving, underwater hard target.

The element 76 of FIG. 12 is designed to generate a suitable acoustic signal by an acoustic signal generating wheel 77 disposed in the case 78 which may, at least in part, consist of a magnetic material for attachment to the submarine. It again has a nose portion 74 of a water soluble insulating material.

After the element 76 has attached itself horizontally to the hull of the submarine, water will flow in the direction shown by arrow 80 and will leave the case 78, as shown by arrow 81, thereby to drive a turbine wheel 82 connected to the acoustic wheel 77. Stabilizing tail fins 26 may again be provided on the element 76. The relative flow of water is, of course, caused by the motion of the submarine underwater.

Figure 13:
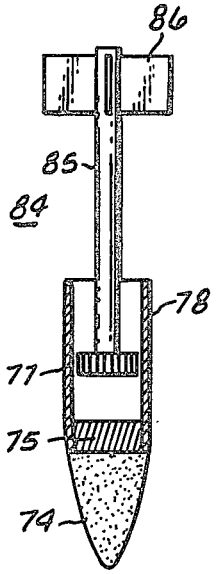
FIG. 13 is an elevational view of another element to be used for locating a hard target underwater and including a hinged paddle wheel or fins for rotating an acoustic signal generating wheel when attached to a moving target.
Figure 14:
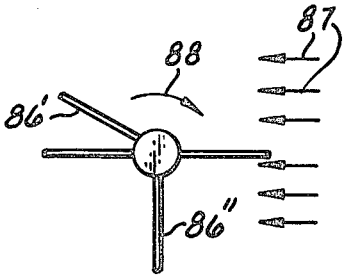
FIG. 14 is a schematic top plan view of the hinged paddle wheel to illustrate its operation.

Referring now to FIG. 13, there is illustrated an element 84 having a metallic casing 78 with a magnetized nose section 75 followed by a nose tip 74 which consists again of a water soluble insulating material. An acoustic wheel 77 is mounted for rotation in the case 78 and is connected by a shaft 85 to a special paddle wheel 86 having hinged paddle fins to permit rotation when the submarine is in motion. The paddle fins 86 are shown schematically in FIG. 14. The motion of the water is shown by the arrows 87 which cause rotation of the paddle wheel in the direction shown by arrow 88. As seen here, the paddle fins 86 are hinged, as shown at 86' to rotate in a counter-clockwise direction while so fixed as to prevent rotation in a clockwise direction. Hence, the full force of the water acts on the paddle wheel 86'' while the paddle wheel 86' is rotated out of the way.

Hence, it will be evident that the paddle wheels 86 permit rotation of the acoustic wheel 77 to generate a suitable acoustic signal.

Figure 15:
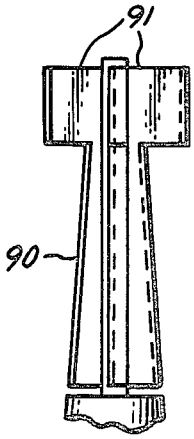
FIG. 15 is another elevational view of the rear end of an element of the type shown in FIG. 13 and illustrating another design of a paddle wheel for driving a mechanism.
Figure 16:
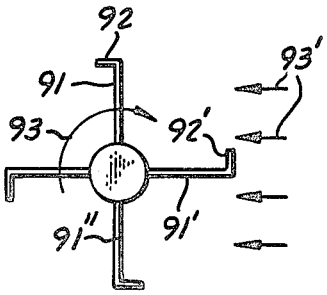
FIG. 16 is a top plan view of the paddle wheel of FIG. 15.

An alternate paddle design is illustrated in FIGS. 15 and 16, to which reference is now made. Here the rear portion 90 of an element is provided with a paddle wheel 91. The paddles 91 are shown in top plan view in FIG. 16. Each paddle 91 is provided with an end portion 92 at right angles to the main portion of the paddle. Thus, in the position shown in FIG. 16, the paddle 91' and its end portion 92' will reduce the effective area of paddle 91 to the water motion shown by arrows 93'. On the other hand, the paddle 91'' has its entire area exposed to the water and, accordingly, rotation in a clockwise direction as shown by arrow 93 results.

Figure 17:
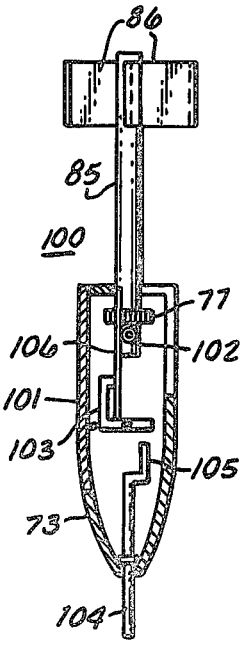
FIG. 17 is an elevational view of an element adapted to attach itself by magnetic force to a moving, underwater hard target and including a pivotable paddle wheel for rotating an acoustic signal generating wheel.

Still a different construction is illustrated in FIG. 17 of the element 100. The element 100 has a case 73, only one portion 101 of which is made magnetic for attachment to a metallic surface of a hard, underwater target. An acoustic wheel 77 is rotatably disposed in the casing 73 and may be rotated by the shaft 85 and the hinged paddle fins 86.

Acoustic wheel 77, shaft 85, and paddle fins 86 have a common pivot point at 102. There is also provided a pivoted lock pin 103 which normally locks the assembly in the position shown in FIG. 17. Upon impact of the element on a hard target, an activation rod 104 is depressed inwardly of the case 73 thereby to unlock the lock pin 103 by the offset portion 105 of the activation rod 104. This in turn will free a spring means 106 which will cause the entire assembly to rotate at right angles. Accordingly, when the element is attached to a metallic hull, say of a submarine, by the magnetic portion 101, the entire assembly will rotate through 90°. Hence, motion of the submarine will cause the paddle wheel 86 to rotate as well as the acoustic wheel 77 thereby to generate an acoustic signal which can be used to locate the submarine.

It will be understood that the paddle fin construction of FIGS. 15 and 16 may be used instead of the paddle wheel 86.

Figure 18:
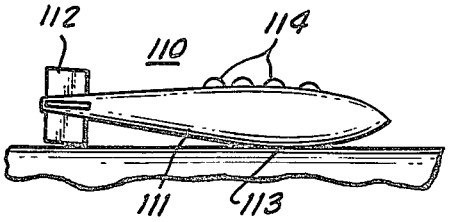
FIG. 18 is an elevational view of another target identifying element, at least a portion of its surface being provided with means for retroreflecting light, such as laser light.

FIG. 18, to which reference is now made, shows another element 110 which may be used to reflect light energy. The element 110 has a body portion 111 of aerodynamic shape and may be provided with stabilizing tail fins 112. One portion 113 of the housing may consist of magnetic material so that the element can attach itself to a submarine or other hard target underwater. The surface opposite the magnetic surface 113 is provided with suitable reflectors 114 for light. These may be retroreflectors for laser energy or else a Luneberg lens for reflecting a particular frequency range of light.

It will be realized that the elements illustrated in FIGS. 11–18 are specifically designed for identifying an underwater target. Because they have to travel through the water, these elements will have a low-speed impact. They are designed to adhere to a metallic surface, such as a submarine hull by a magnetic portion. The motion of the submarine is used to energize suitable wheels or fins to generate mechanical energy. This may now be used to emit an acoustic signal underwater, either by an electro-acoustic transducer or directly by an acoustical wheel. Alternatively, the element may be provided with reflectors for light, such, for example, as a blue-green laser.

There has thus been disclosed a system for identifying a hard target either on the ground or below the surface of the water. A large number of kinetic penetrator elements or the like may be scattered over a large area. The elements are so designed that they will attach themselves to the hard target while being absorbed by the surrounding area, such as ground or water. The elements may be passive elements and designed to reflect wave energy, such as acoustic or electromagnetic energy. Alternatively, they may be designed as active elements for emitting electromagnetic radiation or for reflecting a harmonic of a transmitted electromagnetic frequency. The elements are difficult to remove from, say a travelling vehicle or a road. Additionally, another class of elements is designed to be attached to a submarine underwater or the like. In that case, the elements may generate acoustic energy to locate the target. They may be driven by the relative motion of the water, due to the moving target.

Although there have been described above specific methods for identifying a hard target, it will be appreciated that the invention is not limited thereto. Accordingly, any and all modifications, variations or equivalent arrangements which may occur to those skilled in the art should be considered to be within the scope of the invention as defined in the appended claims.

I claim:

1. The method of using a plurality of kinetic penetrator elements to identify a hard target and distinguish said target from other, more penetrable areas adjacent said target to enable subsequent bombardment of a thus-identified target by direct aiming of projectiles at said target comprising the steps of:

dropping a plurality of said elements in a region in which potential targets may be located, which elements have means for reflecting electromagnetic radiation received from a remote source to indicate their presence to a remote detector when in contact with a target and the capability of penetrating to the point of disappearance those areas adjacent a hard target which are not part of the target to be identified transmitting electromagnetic radiation from said remote source in the direction of said region; and detecting said reflected electromagnetic radiation from said elements in contact with a target in order to identify the location of said target.

2. The method of claim 1 further comprising the step of subsequently bombarding a thus-identified target.

3. The method of claim 1 wherein the step of dropping a plurality of said elements includes dropping a delivery vehicle which contains a plurality of said elements disposed to be ejected from said delivery vehicle after the vehicle is dropped.

4. The method of claim 1 or claim 3 wherein the step of dropping a plurality of said elements further includes dropping a plurality of elements having a nose portion of aerodynamic shape and a plurality of fins connected thereto, said dropping of elements occurring from a distance above the target area such that the dropped elements reach a velocity and kinetic energy sufficient to penetrate partially into a hard target and be retained therein with a portion projecting therefrom.

5. The method of claim 1 wherein said reflecting means comprise a monopole antenna having predetermined dimensions for reflecting electromagnetic energy of a predetermined frequency.

6. The method of claim 5 further including the step of connecting the monopole antenna in a circuit including a diode to provide the monopole antenna with the capability of generating a multiple of the electromagnetic radiation frequency.

7. The method of claim 1 wherein the step of transmitting electromagnetic waves comprises the step of transmitting visible light.

8. The method of claim 4 wherein said nose portion is formed of hardened steel to enable the element to penetrate at least partially into a hard target and to be embedded therein.

9. The method of claim 8 wherein the nose portion curves upon impact with the target so as to inhibit removal of the embedded element from the target.

10. The method of claim 4 wherein each of said elements has a body portion extending between the nose portion and the fins and further includes a retroreflector at the rear of the element behind the fins.

11. The method of claim 10 wherein the retroreflector is adapted to reflect laser radiation in a predetermined frequency range.

12. The method of claim 11 wherein the retroreflector comprises a Luneberg lens.

13. The method of claim 10 wherein the body portion is coated with a light reflective material.

14. The method of claim 4 wherein the fins are configured to act as a corner reflector for light energy.

* * * * *